US005370808A

United States Patent [19]

Onishi et al.

[11] Patent Number: 5,370,808

[45] Date of Patent: Dec. 6, 1994

[54] FILLING GREASE COMPOSITION FOR AUTOMOBILE WIRE HARNESS CONNECTOR

[75] Inventors: Yasuhiko Onishi, Seto; Akihiro Yokono, Mie; Yoshinobu Kubo, Yokkaichi; Hirotsugu Kinoshita, Kawasaki; Masaru Mishima, Kawasaki; Makoto Sekiya, Kawasaki, all of Japan

[73] Assignees: Nippon Oil Co., Ltd.; Sumitomo Wiring Systems, Japan

[21] Appl. No.: 38,006

[22] Filed: Mar. 29, 1993

Related U.S. Application Data

[63] Continuation of Ser. No. 470,575, Jan. 26, 1990, abandoned.

[30] Foreign Application Priority Data

Jan. 26, 1989 [JP] Japan ..... 1-016900

[51] Int. Cl.[5] ..... C10M 115/08

[52] U.S. Cl. ..... 252/51.5 A; 307/10.1

[58] Field of Search ..... 252/51.5 A; 307/10.1

[56] References Cited

U.S. PATENT DOCUMENTS

| | | | |
|---|---|---|---|
| 3,868,329 | 2/1975 | Brown et al. | 252/17 |
| 3,920,571 | 11/1975 | Crocker | 252/25 |
| 3,983,041 | 9/1976 | Abbott | 252/17 |
| 4,066,559 | 1/1978 | Rohde | 252/10 |
| 4,100,081 | 7/1978 | Dreher et al. | 252/25 |
| 4,115,284 | 9/1978 | Kinoshita et al. | 252/29 |
| 4,165,329 | 8/1979 | Dreher et al. | 260/404.5 |
| 4,263,156 | 4/1981 | Caruso | 252/51.5 A |
| 4,371,446 | 2/1983 | Kinoshita et al. | 252/51.5 A |
| 4,529,530 | 7/1985 | Shimizu et al. | 252/51.5 A |
| 4,668,411 | 5/1987 | Yasui et al. | 252/51.5 A |
| 4,713,191 | 12/1987 | Nalesnik | 252/51.5 A |
| 4,759,859 | 7/1988 | Waynick | 252/18 |
| 4,780,231 | 10/1988 | Kinoshita et al. | 252/51.5 A |
| 4,915,860 | 4/1990 | Kinoshita et al. | 252/51.5 R |

FOREIGN PATENT DOCUMENTS 0274756 7/1988 European Pat. Off. .

*Primary Examiner*—Jerry D. Johnson

*Attorney, Agent, or Firm*—Ostrolenk, Faber, Gerb & Soffen

[57] ABSTRACT

This invention relates to a filling grease composition for automobile wire harness connector which comprises a petroleum oil having an initial boiling point of 400° C. or more and a gelling agent having the general formula:

wherein R is a divalent aromatic group represented by a member:

as essential components, and the content of said gelling agent ranging from 5 to 50% by weight on the basis of the whole composition.

14 Claims, 1 Drawing Sheet

FILLING GREASE COMPOSITION FOR AUTOMOBILE WIRE HARNESS CONNECTOR

This is a continuation of application Ser. No. 07/470,575, filed Jan. 26, 1990, now abandoned.

BACKGROUND OF THE INVENTION

1. Field of the Invention

This invention relates to a filling grease composition for automobile wire harness connector, and more particularly to a filling grease composition for automobile wire harness connector having various excellent properties, especially excellent heat- and corrosion-resisting properties.

2. Description of the Prior Art

A variety of equipment is used in automobile, one of which is wire harness connector. This small wire harness connector is provided with a number of plate-like wiring disposed in close relation to each other. Accordingly, disadvantages such as inferior energization, short-circuit and the like appear easily without any modification because of such cause for invasion of foreign matters or the like. In order to prevent such disadvantages, the connector is filled with grease. Properties required for inhibiting the above described disadvantages are anti-corrosive property with respect to metal, heat-resisting properties (oil separation, softening, evaporation, high dropping point, high flash point, and oxidative stability), water repellency and the like. As the grease used for such purpose, there has been heretofore lithium soap grease.

However, such lithium soap grease exhibits insufficient water repellency, and there have been troubles such as inferior energization, short-circuit and the like in the case where the temperature in the vicinity of the connector rises with the rise of temperature in the engine room.

SUMMARY OF THE INVENTION

The present inventors have made a wider and deeper study of filling grease compositions in order to prevent the above-mentioned troubles. As a result, it was found that such grease in which a urea compound of a specified construction is used as its gelling agent had very excellent properties so that the present invention has been completed.

It is an object of the present invention to provide a filling grease composition for automobile wire harness connector having especially excellent heat-resisting properties as well as the other various properties.

The invention relates to a filling grease composition for automobile wire harness connector which comprises a petroleum oil having an initial boiling point of 400° C. or more and a gelling agent having the general formula:

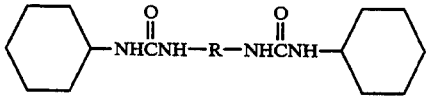

wherein R is a divalent aromatic group represented by a member:

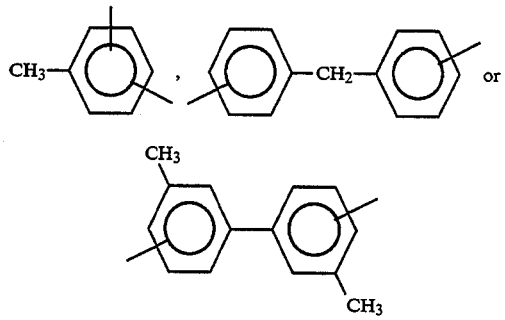

as essential components, and a content of said gelling agent ranging from 5 to 50% by weight on the basis of the whole composition.

DETAILED DESCRIPTION OF THE INVENTION

Figure 1:
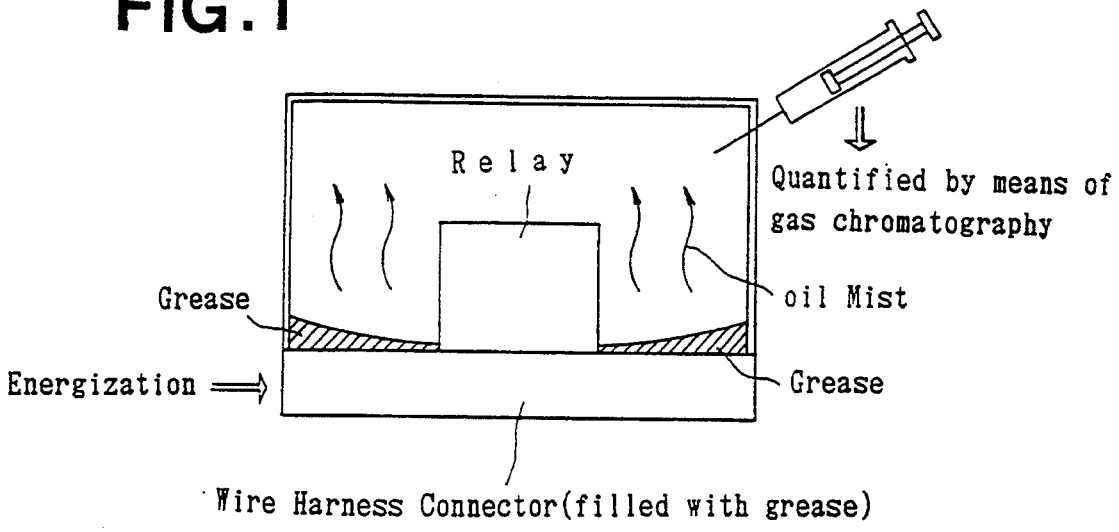
FIG. 1 is a view showing a testing device used for an actual wire harness connector durability test.

The contents of the present invention will be described in more detail hereinbelow.

Base oils used for the grease according to the present invention are petroleum lubricating base oils each having an initial boiling point of 400° C. or more. It is to be noted that the term "initial boiling point" used in this invention means that measured by gas chromatographic distillation. A specific example of these base oils includes SAE 50, bright stock and the like, and they may be ones purified in accordance with a suitable combination of vacuum distillation, solvent deasphalting, solvent extraction, hydrocracking, solvent dewaxing, sulfuric acid washing, clay purification, hydrofinishing and the like processes.

In case where a base oil of those mentioned above has an initial boiling point lower than 400° C., the oil content which will be evaporated at elevated temperatures from the resulting grease increases, and the oil component carbonizes at a site where it sparks; in a wire harness connector so that it becomes a cause of short-circuit. Thus, a base oil having an initial boiling point lower than 400° C. is undesirable. Furthermore, any base oil having a viscosity range which corresponds to that of lubricating oil employed commonly may be available. However, it is preferable that a base oil has a viscosity of 10 cSt or more at 100° C. in order to satisfy such a condition that the base oil has an initial boiling point of at least 400° C.

Gelling agents used in the grease compositions according to the present invention are those having the general formula:

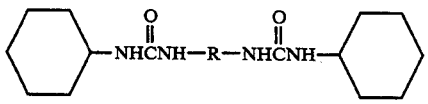

wherein R is a divalent aromatic group represented by the general formula:

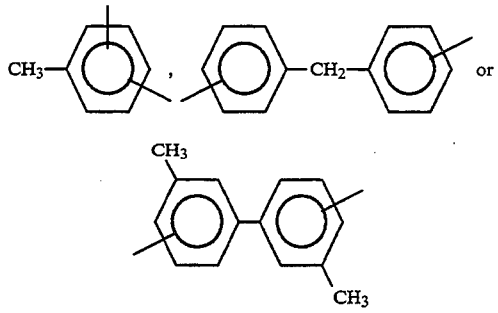

It is undesirable in the case where gelling agents other than the compounds represented by the above formula are used, since various properties required for filling grease for wire harness connector are not satisfied by the latter compounds.

Compounds which are gelling agents used for the grease according to the present invention and have the general formula:

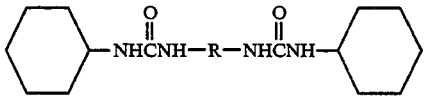

may be manufactured by any suitable process. In general, however, these compounds can be easily manufactured by reacting diisocyanate having the general formula OCN—R—NCO with cyclohexylamine having the formula

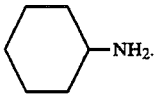

More specifically, cyclohexylamine is admixed with a solvent, and the resulting solution is then reacted with diisocyanate. The solvent may be volatile ones such as benzene, toluene, xylene, hexane, naphtha, diisobutyl ether, carbon tetrachloride, petroleum ether and the like. Furthermore, lubricating base oil may be used as a more suitable solvent. In this case, it is preferable that a reaction temperature ranges from 10° to 200° C. In case of the reaction as described above, the components must be sufficiently admixed and agitated.

The solvent is removed from the gelling agent thus manufactured in the case where a volatile solvent is used, and an appropriate amount of a lubricating base oil is added thereto to obtain the grease. On one hand, when a lubricating base oil is used as a solvent, the resulting solution may serve as the grease without any additional procedure.

Such an additive which elevates further properties of the grease according to the present invention without damaging the properties thereof may be added to the grease. More specifically, additives, for example, the other gelling agents such as metallic soap, bentonite, silica gel, the other urethane compounds and the Like; amine, phenolic, sulfur and the like antioxidants; amine, ester, phosphorus, carboxylic acid, carboxylate, sulfonate and the like anticorrosives; metal inactivating agents such as benzotriazole, thiodiazole and the like may be added to the grease to further improve properties of the resulting grease Further, the content of a compound used as a gelling agent in the grease composition according to the present invention and represented by the general formula:

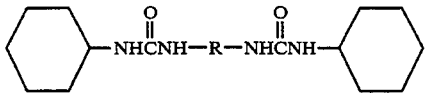

is within a range of from 5 to 50% by weight, preferably from 7 to 20% by weight on the basis of the whole amount of the composition. In the case when the content of the above described compound is less than 5% by weight, the compound is ineffective as a gelling agent, whilst when the content thereof is more than 50% by weight, the resulting grease becomes too viscous so that sufficient advantages cannot be obtained in both the cases for filling wire harness.

EXAMPLES

Example 72.8 g of diphenylmethane-4,4'-diisocyanate was added to 500 g of a mineral oil (30.2 cSt at 100° C.) having an initial boiling point of 432° C., and the mixture was heated to 60° C. to homogeneously dissolve the same. To the resulting solution was added another solution which had been obtained by dissolving 57.2 g of cyclohexylamine into 360 g of the same mineral oil, the solution thus obtained was vigorously agitated to produce a gelled material at once. The material was heated up to 130° C. while continuing the agitation, and the resulting material was then allowed to pass through a triple roll mill to obtain grease to be manufactured. The content of the gelling agent represented by the formula:

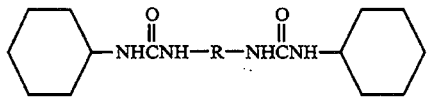

contained in the final grease was 13% by weight.

Figure 2:
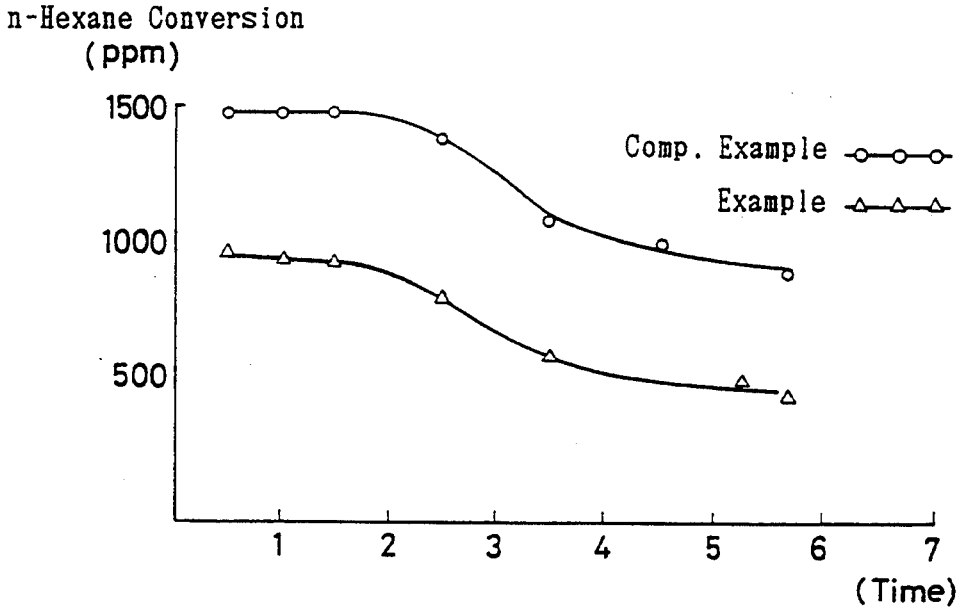
FIG. 2 is a graphical representation showing the test results of the actual wire harness connector durability test.

The following performance test was effected upon the grease thus obtained, and the results thereof are shown in Table 1 and FIG. 2.

(Performance Evaluation Test)

Dropping Point: measured in accordance with JIS K 2220 5.4 dropping point testing method.

Oil separation: measured in accordance with JIS K 2220 5.7 oil separation testing method.

Evaporation Loss: measured in accordance with thin film heating test.

Immiscible Consistency: measured in accordance with JIS K 2220 5.3 consistency testing method.

Flash Point: measured in accordance with JIS K 2265 flash point of crude oil and petroleum product testing method.

Oxidative Stability: measured in accordance with JIS K 2220 oxidative stability testing method.

Washing Water Resistance: measured in accordance with JIS K 2220 washing water resistance testing method.

Actual Wire Harness

Connector Durability Test: oil mist evaporated by the use of the testing device shown in FIG. 1 at 100° C. under energizing condition was quantified by means of gas chromatography.

Comparative Example

The same performance evaluation test as that of the above Example was also effected upon commercially available lithium soap grease for connector (the base oil has an initial boiling point of 356° C., and a kinetic viscosity of 16.2 cSt at 100° C.), and the results thereof are also shown in Table 1 and FIG. 2.

TABLE 1

| | Example | Comp. Example |
|---|---|---|
| Dropping Point (°C.) | 260° C. or more | 195 |
| Oil Separation (200° C., 24 hrs.) (%) | 3.4 | 67.8 |
| Evaporation Loss (150° C., 200 hrs.) (%) | 3.3 | 42.3 |
| Immiscible Consistency 25° C. | 330 | 263 |
| 150° C. | 360 | 461 |
| Flash Point (COC) (°C.) | 300 or more | 250 |
| Oxidative Stability (99° C., 500 hrs.) ($Kgf/cm^2$) | 0.35 | 2.55 |
| Washing Water Resistance (79° C.) (%) | 0.1 | 5.2 |

As is apparent from the results shown in Table 1 and FIG. 2, the grease according to the present invention exhibits excellent properties as the one for filling automobile wire harness connector. Comparing the results of the grease of this invention with those of prior art products, the latter exhibits inferior properties than that of the invention in any test as listed above.

What is claimed is:

1. A filling grease composition for automobile wire harness connector consisting essentially of a petroleum oil having an initial boiling point of 400° C. or more and a gelling agent consisting essentially of an agent having the general formula:

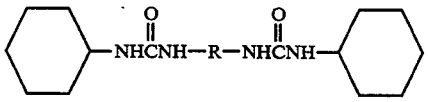

wherein R is a divalent aromatic group represented by a member:

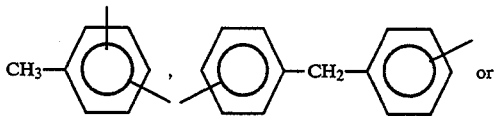

-continued

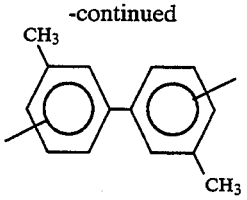

as essential components, and the content of said gelling agent ranging from 5 to 50% by weight on the basis of the whole composition.

2. The filling grease composition of claim 1 wherein R is

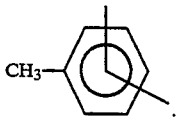

3. The filling grease composition of claim 1 wherein R is

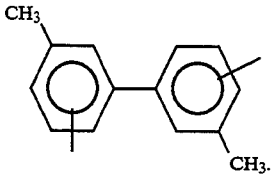

4. The filling grease composition of claim 1 wherein R is

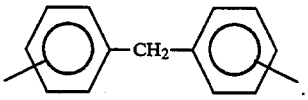

5. The filling grease composition of claim 1 wherein R is

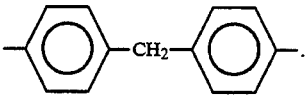

6. The filling grease composition of claim 5, in which the petroleum oil has an initial boiling point of 432° C. and the content of gelling agent is 13% by weight.

7. The filling grease composition of claim 1, in which the content of gelling agent is 7–20% by weight.

8. An automotive wire harness connector filled with the filling grease composition according to claim 1.

9. An automotive wire harness connector filled with the filling grease composition according to claim 2.

10. An automotive wire harness connector filled with the filling grease composition according to claim 3.

11. An automotive wire harness connector filled with the filling grease composition according to claim 4.

12. An automotive wire harness connector filled with the filling grease composition according to claim 5.

13. An automotive wire harness connector filled with the filling grease composition according to claim 6.

14. An automotive wire harness connector filled with the filling grease composition according to claim 7.

* * * * *